United States Patent [19]

Watahiki et al.

[11] Patent Number: 4,930,917

[45] Date of Patent: Jun. 5, 1990

[54] SOUNDPROOF CONSTRUCTION IN PRINTER BOX

[75] Inventors: Shinichi Watahiki; Nobuhiko Itoh; Masao Miyasaka, all of Katsuta, Japan

[73] Assignee: Hitachi Koki Co., Ltd., Tokyo, Japan

[21] Appl. No.: 190,351

[22] Filed: May 5, 1988

[30] Foreign Application Priority Data

May 9, 1987 [JP] Japan ..... 62-69184[U]

[51] Int. Cl.[5] ..... B41J 29/08

[52] U.S. Cl. ..... 400/690; 400/691

[58] Field of Search ..... 400/689, 690, 690.1, 400/690.2, 690.3, 690.4, 691

[56] References Cited

U.S. PATENT DOCUMENTS 4,330,219 5/1982 Miyasaka et al. ..... 400/690.4

OTHER PUBLICATIONS

Research Disclosure, Jul. 1987, No. 279, Kenneth Mason Publications Ltd., England.

*Primary Examiner*—Edgar S. Burr

*Assistant Examiner*—Ren Yan

*Attorney, Agent, or Firm*—Sixbey, Friedman, Leedom & Ferguson

[57] ABSTRACT

A sound reducing construction for shielding sound in a confined box, the box including a first plate component formed with a first open end portion and a second plate component formed with a second open end portion and accommodating therein a machine which generates the sound, the first plate component being movable with respect to the second plate component. The sound reducing construction comprises: a packing unit having one end fixed to the first open end portion of the first component and having another end portion in contact with the second open end portion when the first component is rested on the second component; and, the first and second open end portions providing stepped portions in conformance with each other. The first and second open end portions define two horizontally extending gaps whose vertical heights are different from each other and a vertically extending gap. The packing unit is positioned in one of the horizontally extending gap. The first and second component are cover and a main box which houses a printer therein.

12 Claims, 3 Drawing Sheets

SOUNDPROOF CONSTRUCTION IN PRINTER BOX

BACKGROUND OF THE INVENTION

The present invention relates to a sound reducing construction for shielding sound generated upon operation of a machine such as a printer, and more particularly, to a type thereof adapted to be provided at a box which accommodates therein a printer for confining sound in the box.

As shown in FIG. 1, a printing machine such as a line printer P is accommodated in a box 100 consisting of a main body 102 and a cover 101 those being formed of metal plates. Within the main body 102, the printer P is accommodated, and the cover 101 is pivotally connected to the main body 102 at its rear portion 101R so as to cover a top surface portion of the printer P. During operation of the printer P, the rectangular lower open end face 101a of the cover 101 is brought into contact with a rectangular open end face 102a of the main body 102 by the pivotal motion of the cover 101, to thereby provide a confined space defined by the main body and the cover.

In order to avoid sound leakage from the box interior to outside, a sound reducing construction has been provided at an interface between the main body 102 and the cover 101. For this, one conventional sound reducing construction is shown in FIG. 2. FIG. 2 shows closed state of the cover 101 and the man body 102 as viewed in a direction indicated by an arrow A in FIG. 1, and left and right side margins of FIG. 2 designate box internal and external portions, respectively. According to the conventional sound reducing construction, a packing unit 103 is provided between the cover 101 and the main body 102. To be more specific, the packing unit 103 includes a resilient packing member **103*a*, a bolt 103*b*, packing holder plates 103*c* and a magnetic member 103d. Inner surfaces of the cover 101 and the main body 102 are provided with sound absorbing members 106, and the side end portion of the metal cover 101 is bent by a right angle to provide a packing attaching portion 101A. The packing member 103*a* formed of soft vinyl chloride has one end portion 103*a'* fixedly attached, through the packing holder plates 103*c*, to the packing attaching portion 101A by the bolt 103*b*. Another end portion 103*a''* of the packing member 103*a* is connected to the magnetic member 103*d* such as a rubber or plastic magnet which is in contact with a bent plate 102A of the main body 102**.

Accordingly, the packing unit 103 seals the interface between the cover 101 and the main body 102 when the cover 101 is closed.

In the conventional sound reducing construction, attention should be drawn to "mass law of sound insulation". That is, the rule states that sound insulation for a single wall is determined almost wholly by its weight per unit area, and doubling the weight of the partition increases the insulation by 5 decibels. In this connection, the packing unit 103 provides a sound transmission loss lower than that of the metal plate portion, so that sufficient sound insulation or reducing effect may not be obtainable at the packing portion. Further, the thickness portion "t" of the packing member **103*a* merely serves as the partition defined in the law, and therefore, sound leakage may occur through the packing portion. Furthermore, according to the conventional structure, it would be rather difficult to conduct clamping work for securing the packing member 103*a* to the cover 101 by using the bolt 103*b*, since the packing member 103*a* must be held with being interposed between the packing holder 103*c* and the packing attaching portion 101A when the bolt 103*b*** is rotationally advanced.

SUMMARY OF THE INVENTION

It is therefore, an object of the present invention to overcome the above-mentioned drawbacks and to provide an improved sound reducing construction for preventing sound generated from an operating machine from leaking through a machine accomodation box.

Another object of this invention is to provide such sound reducing construction capable of providing sufficient sound transmission loss, to thereby reduce leakage of the sound at minimum level.

Still another object of this invention is to provide such sound reducing construction which alleviates labor for attaching a sound reducing unit to the box.

These and other objects of this invention will be attained by a sound reducing construction provided between first and second components and sealingly maintained when the first component is rested on the second component. In this invention, there is provided a sound reducing construction for shielding sound in a confined box, the box including a first plate component formed with a first open end portion and a second plate component formed with a second open end portion and accommodating therein a machine which generates the sound, the first plate component being movable with respect to the second plate component. The sound reducing construction comprises: a packing unit having one end fixed to the first open end portion of the first component and having another end portion in contact with the second open end portion when the first component is rested on the second component; and, the first and second open end portions providing stepped portions in conformance with each other. The first and second open end portions define two horizontally extending gaps whose vertical heights are different from each other and a vertically extending gap. The packing unit is positioned in one of the horizontally extending gaps.

Since the vertically confronting walls of the cover and the main body serve to block noise or sound resulting in an increase in sound transmission loss. Further, the bent gap defined between the open end portions can attenuate the sound generated in the main body, to thus minimize leakage of sound out of the box confined by the packing unit.

DETAILED DESCRIPTION OF THE PREFERRED EMBODIMENTS

Figure 3:
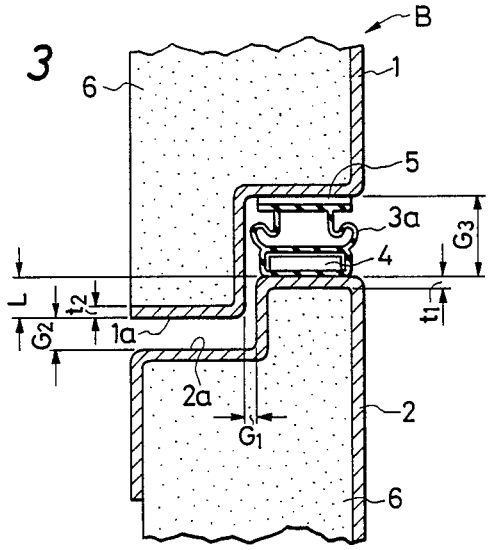
FIG. 3 is a cross-sectional view showing a sound reducing construction according to a first embodiment of this invention.

A first embodiment of this invention will be described with reference to FIGS. 3 and 4. FIG. 3 is viewed in a direction indicated by arrow A in FIG. 1, so that the left and right side margins in FIG. 3 designate internal and external portions with respect to a box B. The sound reducing structure B includes a main body 2 (referred to as a second component in claims) and a cover 1 (referred to as a first component in claims), each being provided with sound absorbing members 6 in their inner surfaces, and the confronting surfaces between the cover 1 and the main body 2 are stepped to define a pair of horizontal portions and a vertical riser portion That is, the cover 1 has a lower open end 1*a* (referred to as a first open end in claims) confronting an upper open end 2*a* (referred to as a second open end in claims) of the main body 2, and the lower open end portion 1*a* of the cover 1 is not flat but steppingly arranged which stepped shape is in conformance with a stepped shape of the upper open end 2*a* of the main body 2. In other words, metal plates of the cover and the main body are bent three times to provide the aforementioned horizontal and riser portions In the confronting portion, there are two horizontally confronting portions and a vertically confronting portion directed in a direction perpendicular to the horizontally confronting portions. The two horizontally confronting portions have vertical heights different from each other because of the bending arrangement. Further, gaps $G_2$ and $G_3$ are defined at the horizontally confronting portions, and gap $G_1$ is defined at the vertically confronting portion. It goes without saying that these gaps are minimumly provided for ensuring sound reducing effect. Here, a length L defined by vertical confrontation between the vertical portions of the cover member 1 and the main body 2 is larger than the thicknesses thereof ($t_1$ plus $t_2$). If large length L can be provided, sound reducing effect will be enhanced. Because of the vertically confronting walls, numbers of the sound insulation wall is increased to enhance sound insulation effect.

Further, in one of the horizontally confronting portions (in the gap $G_3$) positioned near the distal side face of the cover or main body, a packing unit 3 is provided.

Figure 4:
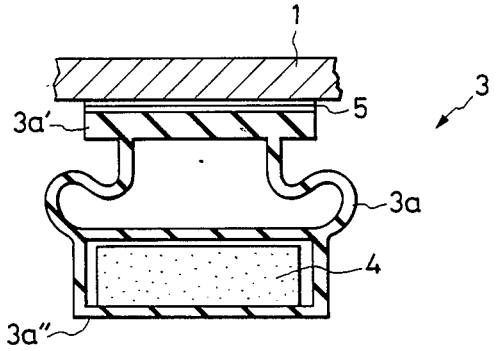
FIG. 4 is a cross-sectional view particularly showing a packing unit according to the present invention.

Referring to FIG. 4, the packing unit 3 includes a flexible packing member 3*a* formed of soft vinyl chloride whose one end portion 3*a*′ is secured to the cover 1 by an adhesive member 5 such as a double-faced adhesive tape. Within the packing member 3*a* at end portion 3*a*″ thereof, a magnetic member 4 such as a rubber magnet or plastic magnet is disposed as best shown in FIG. 4. The packing member 3*a* is in a form of flat barrel shape as shown when the cover is closed. The barrel portion is slightly stretched in an axial direction of the packing member 3*a* when the cover 1 is opened. The rubber or plastic magnet is well known, in which magnetic particles are dispersed in a rubber or plastic material to obtain flexible magnetic member. The magnetic member 4 is in close contact with the main body end face 2*a* at the gap $G_3$. Because of the magnetic force of the magnetic member 4, the cover 1 is not jumped up from the upper end face 2*a* of the main body 2 due to minute vibration caused during printing operation.

Figure 5:
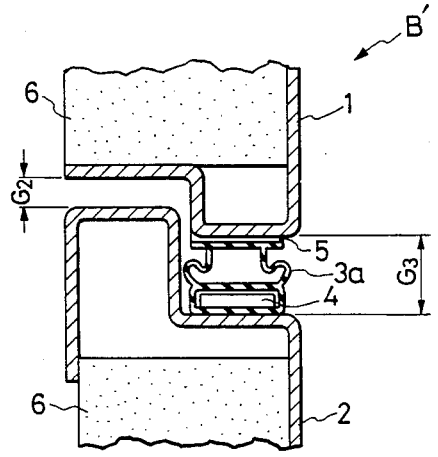
FIG. 5 is a cross-sectional view showing a sound reducing construction according to a second embodiment of this invention.

A sound reducing structure B′ according to a second embodiment of this invention is shown in FIG. 5 wherein the stepping orientation is opposite to that in the first embodiment. With this structure, excellent sound reducing effect is obtainable similar to the first embodiment.

Figure 6:
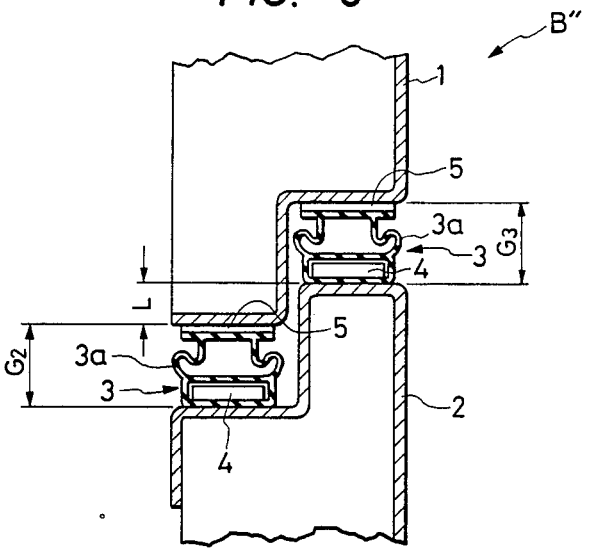
FIG. 6 is a cross-sectional view showing a sound reducing construction according to a third embodiment of this invention.

A sound reducing structure B″ according to a third embodiment of this invention is shown in FIG. 6, wherein two packing units 3 and 3 are provided at the horizontally confronting portions (at portions corresponding to gaps $G_2$ and $G_3$) so as to enhance sound shielding effect. However, in the third embodiment, attention should be drawn to the gap $G_2$ which is greatly larger than the gap $G_2$ in the foregoing embodiments. Due to the increase in the gap, the overlapping length L becomes short. Therefore, even in the third embodiment, the length L should be larger than the lengths $t_1$ plus $t_2$.

Figure 1:
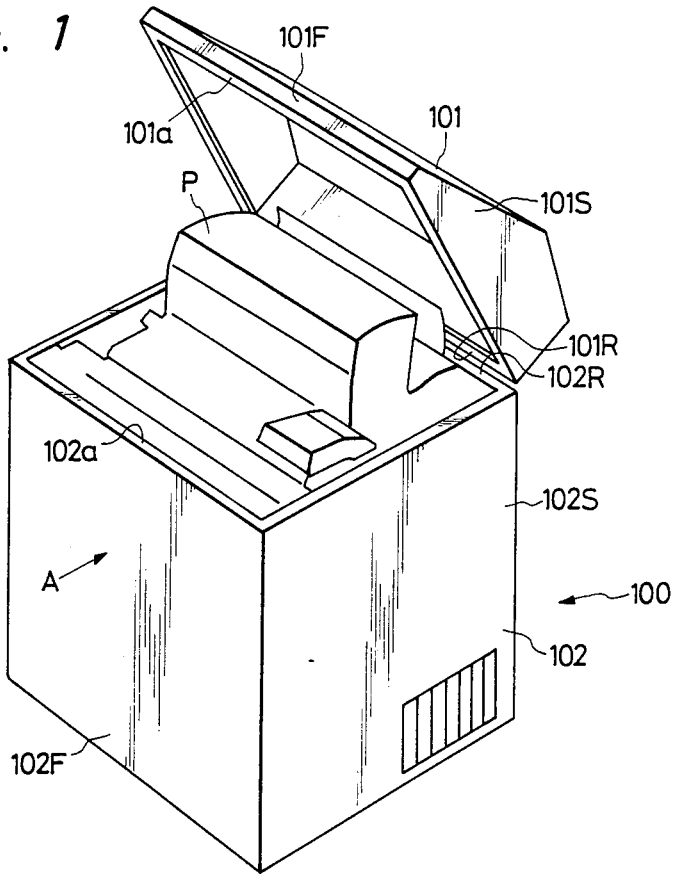
FIG. 1 is a perspective view showing a printer and a printer housing box which includes a main body and a cover.
Figure 2:
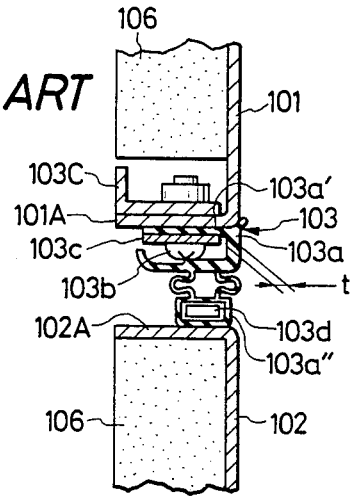
FIG. 2 PRIOR ART
FIG. 2 is a cross-sectional view showing a conventional sound reducing construction provided between the main body and a cover.
Figure 7:
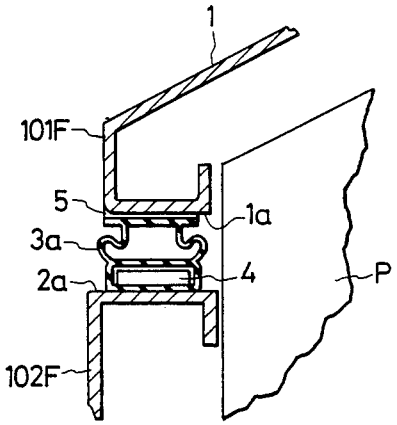
FIG. 7 is a cross-sectional view showing a sound reducing construction which is provided between a front end of a cover and a front end of a main body; and, FIG. 8 is a cross-sectional view showing a sound reducing construction which is provided at a rear hinge portion of a box.
Figure 8:
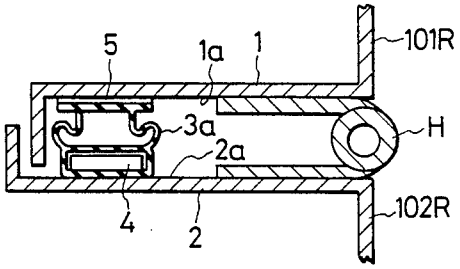
Figure 9:
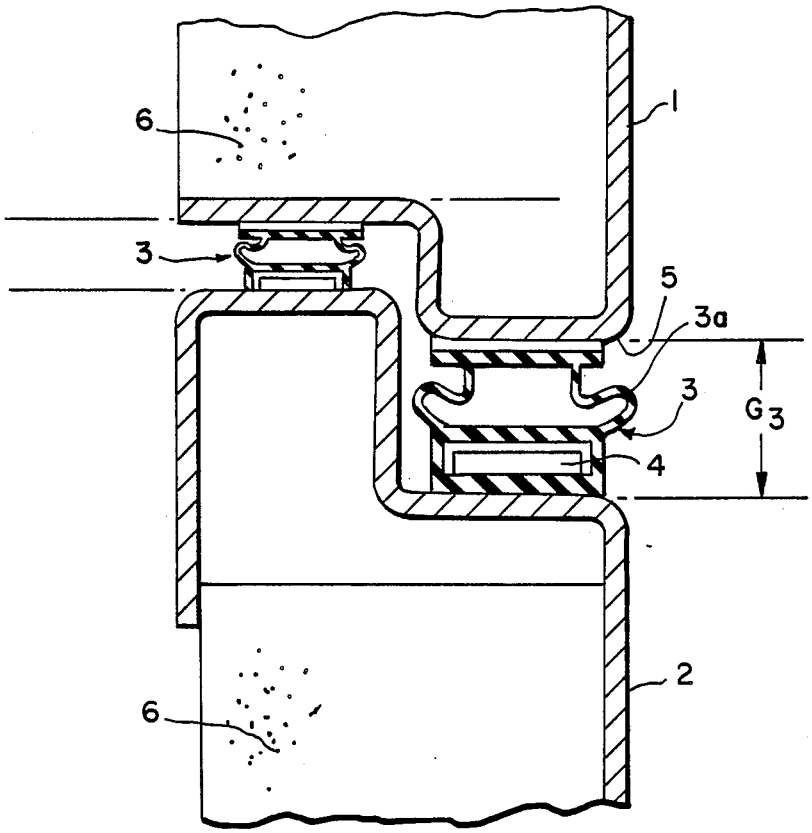
FIG. 9 is a cross-sectional view according to a fourth embodiment of this invention.

According to the foregoing embodiments, the packing units are provided at the side wall portions of the cover 1 and the main body 2 (see 101S and 102S in FIG. 1). However, the packing unit can be provided between the front walls of the cover and the main body (see 101F and 102F) as shown in FIG. 7, or can be provided between the rear walls thereof (see 101R and 102R) as shown in FIG. 8. In the latter case, a hinge member H is fixed to the walls 101R and 102R for pivotally moving the cover 1.

In view of the foregoing, according to the sound reducing construction of this invention, the packing unit is attached to the printer box by adhesive, additional mechanical component for securing the unit to the box can be eliminated. Further, the open end portions of the cover and the main body are bent at three times to provide stepped faces, so that these portions provide excellent mechanical strength or rigidity. Furthermore, since the packing unit is attached without using the packing holder and screw, the gap space in which the packing unit is provided can be minimized, to thus further enhance sound reducing effect.

While the invention has been described in detail and with reference to specific embodiments thereof, it will be apparent for those skilled in the art that various changes and modifications can be made therein without departing from spirit and scope of the invention.

What is claimed is:

1. A sound reducing construction for shielding sound in a confined box, said box including a first plate component formed with a first open end portion and a second plate component formed with a second open end portion and accommodating therein a machine which generates said sound, said first plate component being movable with respect to said second plate component, comprising:

at least one packing unit having one end fixed to said first open end portion of said first component and having another end portion in contact with said second open end portion when said first component is rested on said second component; and each of said first and second open end portions comprising first and second generally horizontal walls interconnected by a generally vertical wall for providing stepped portions in conformance with each other, said stepped portions defining therebetween two horizontally extending gaps interconnected by a vertically extending gap, said at least one packing unit being positioned in at least one of said horizontally extending gaps.

2. The sound reducing construction as defined in claim 1, wherein said first component is a cover member and said second component is a main body, and said machine is a printer, said cover member being pivotably supported to said main body at a rear portion of said first open end portion.

3. The sound reducing construction as defined in claim 1, wherein said one end of said packing unit is secured to said first open end portion by adhesive material, and said another end portion of said packing unit is provided with a magnetic member magnetically contactable with said second open end portion when said first open end portion is rested on said second open end portion.

4. The soundproof construction as defined in claim 1, wherein at said vertically extending gap said first and second components confront with each other, a confronting length being larger than thicknesses of said first and second components.

5. The sound reducing construction as defined in claim 1, wherein said two horizontally extending gaps have vertical heights different from each other.

6. The sound reducing construction as defined in claim 1, including two packing units, one positioned in each of said horizontally extending gaps.

7. The sound reducing construction as defined in claim 7, including two packing units, one positioned in each of said horizontally extending gaps.

8. The sound reducing construction, as defined in claim 1, wherein said two horizontally extending and one vertically extending gap comprise a continuous gap defined between said stepped portions.

9. The sound reducing construction, as defined in claim 7, wherein said two horizontally extending and one vertically extending gap comprise a continuous gap defined between said stepped portions.

10. The sound reducing construction as defined in claim 1, wherein each of said horizontally extending gaps is adapted to accept a packing unit therein.

11. The sound reducing construction as defined in claim 1, wherein said two horizontally extending and one vertically extending gap comprise a continuous bent gap defined between said stepped portions, each of said horizontally extending gaps being adapted to accept a packing unit therein.

12. The sound reducing construction as defined in claim 1, wherein said vertical walls are vertically overlapping.

* * * * *